US005564403A

United States Patent [19]

Codina et al.

[11] Patent Number: 5,564,403

[45] Date of Patent: Oct. 15, 1996

[54] SPARK IGNITION SYSTEM AND SPARK PLUG FOR ULTRA LEAN FUEL/AIR MIXTURES

[75] Inventors: George Codina, North Hollywood, Calif.; James M. Schultz, Chillicothe; J. Thomas Vachon, Peoria, both of Ill.

[73] Assignee: Caterpillar Inc., Peoria, Ill.

[21] Appl. No.: 543,569

[22] Filed: Oct. 16, 1995

[51] Int. Cl.[6] ..... F02P 15/00; H01T 13/20

[52] U.S. Cl. ..... 123/653; 123/169 EL; 123/655; 313/138

[58] Field of Search ..... 123/169 EL, 169 P, 123/620, 653, 654, 655, 656; 313/138, 139, 141

[56] References Cited

U.S. PATENT DOCUMENTS 4,774,914 10/1988 Ward ..... 123/169 EL X
4,841,925 6/1989 Ward ..... 123/169 EL X

*Primary Examiner*—Tony M. Argenbright
*Attorney, Agent, or Firm*—Calvin E. Glastetter

[57] ABSTRACT

A spark ignition system and spark plug for utilization in an internal combustion engine combusting an ultra lean fuel/air mixture has capacitors and rectifiers built within the spark plug and the system is constructed to be compact and capable of delivering a controlled spark that has the physical properties of providing a very fast, high power pulse or train of pulses greater than conventional spark plugs.

12 Claims, 2 Drawing Sheets

SPARK IGNITION SYSTEM AND SPARK PLUG FOR ULTRA LEAN FUEL/AIR MIXTURES

TECHNICAL FIELD

The present invention relates to a spark ignition system and spark plug thereof for use in an internal combustion engine that operates on ultra lean fuel/air mixtures and at higher pressures for improved fuel efficiency and exhaust emissions.

BACKGROUND ART

Although a large amount of research and effort has been devoted to develop a spark plug and spark ignition system for a high compression engine which utilizes lean fuel or air mixtures, the results have been less than satisfactory.

Problems that continue to hamper advancement are higher voltage requirements, higher energy consumption and shortened electrode life.

The present invention is directed to overcome one or more of these problems.

DISCLOSURE OF THE INVENTION

In one aspect of the invention, a spark ignition system for an internal combustion engine has a controllable spark initiation system, a cylinder head, cylinder sidewalls and a piston defining a combustion zone. The cylinder head has a threaded opening and a spark plug positioned in the opening in communication with the combustion zone.

The spark plug has first and second end and first and second end portions. The spark plug first end portion has a connecting element formed of electrically conductive material and has a threaded outer surface mateable with the opening of the cylinder head. The first end portion also has a cavity of ring configuration, a first electrode axially positioned within the cavity and insulation extending about the first electrode and walls of the cavity, thereby defining an insulated cavity of ring configuration.

A second electrode of ring configuration is positioned between the cavity insulation and the connecting element and is in electrical contact with the connecting element.

The spark plug second end portion has a chamber defined by a second end portion of the first electrode. An electrical terminal is connected to the spark initiation system. A plurality of serially connected high voltage rectifiers are connected on one end to a first end portion of the first electrode and connected on the other end to the spark initiation system and are positioned within the chamber.

A second end portion of the second electrode extends about the second end portion of the first electrode. Insulation is positioned between the second end portions of the first and second electrodes and covers the second end portion of the second electrode. The first and second electrodes second end portions are of a construction sufficient to generate a capacitance greater than about 0.01 μF. The insulated outer surfaces of the first end portion cavity and the second end portion of the spark plug have portions of non linear configuration.

In another aspect of the invention, a spark plug of an internal combustion engine utilizing ultra lean fuel mixtures and generating high combustion pressures has a body having first and second ends and first and second end portions. The first end portion has a centrally positioned first electrode and a second electrode of tubular configuration extending about said first electrode and spaced at least about 3 mm therefrom and has threads formed on the first end portion that are mateable with threads of an engine spark plug opening. The second end portion of the spark plug has a plurality of rectifiers serially connected to the first electrode. The rectifiers are encased within the second end portion of the first electrode. The first electrode second end portion is surrounded by the second end portion of the second electrode. The adjacently positioned first and second electrode second end portions are of a construction sufficient for generating a capacitance greater than about 0.01 μF.

BEST MODE FOR CARRYING OUT THE INVENTION

Figure 1:
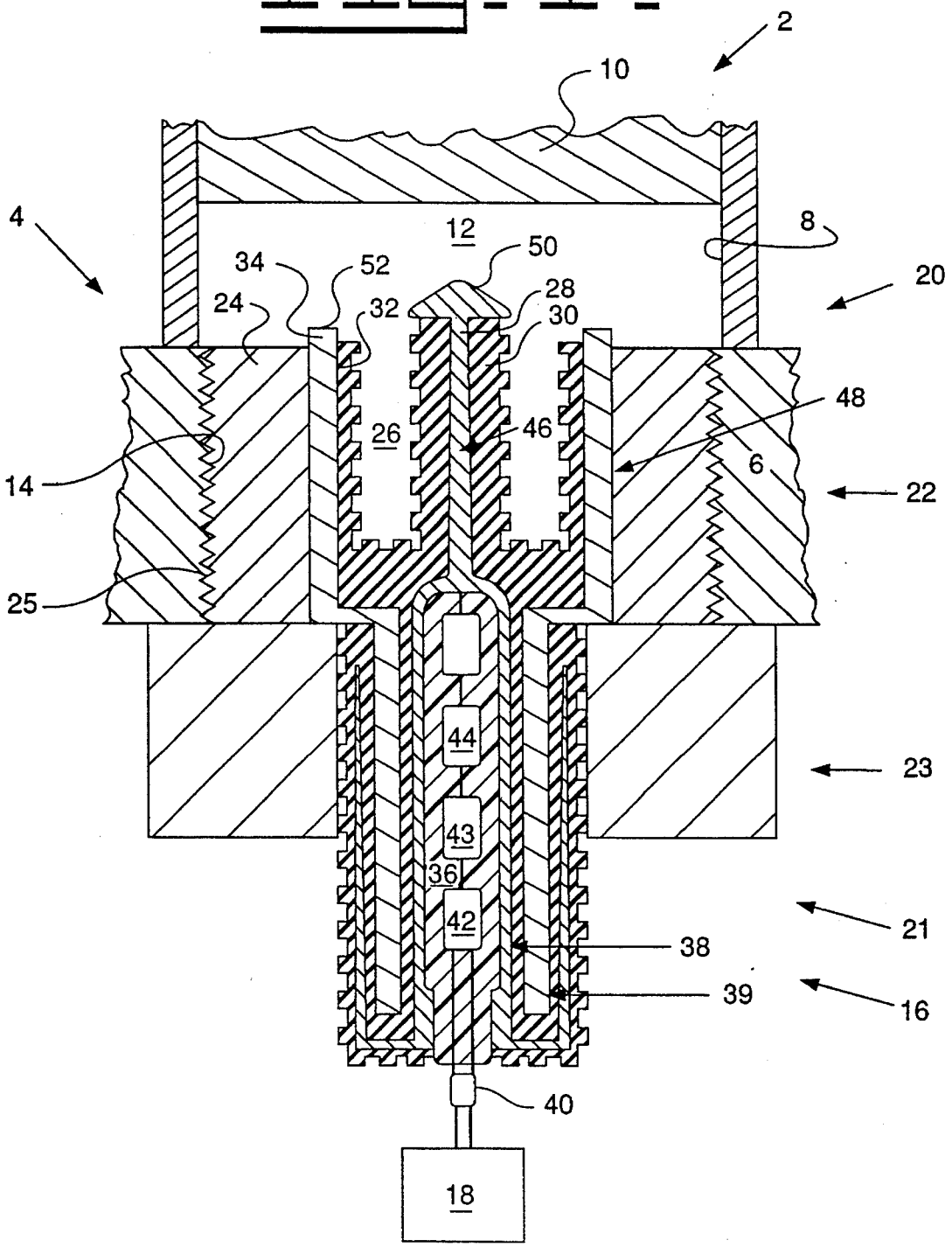
FIG. 1 is a diagrammatic view in cross section showing one embodiment of the invention.

Referring to FIG. 1, an internal combustion engine 2 has a spark ignition system 4. The engine 2 has a cylinder head 6, cylinder sidewalls 8, and a piston 10 defining a combustion zone 12. The cylinder head 6 has a threaded opening 14 and a spark plug 16 positioned in the opening 14 and in communication with the combustion zone 12. A controllable spark initiation system 18, as is well known in the art, is connected to a power source (not shown) and is adapted to energize the spark plug 16 at preselected intervals relative to the position of the piston 10.

The spark plug 16 has first and second ends 20,21 and first and second end portions 22,23. The first end portion 22 of the spark plug 16 has a connecting element 24 formed of electrically conductive material which has a threaded outer surface 25 mateable with the threaded opening 14 of the cylinder head 6.

The first end portion 22 also has a cavity 26 of ring configuration, a first electrode 28 generally axially positioned within the cavity 26. Insulation 30, for example ceramic material, extends about the first electrode 28 and walls 32 of the cavity 26 thereby defining an insulated cavity of ring configuration.

A second electrode 34 of ring or tubular configuration is positioned between the cavity insulation and the connecting element 24 and in electrical contact with the connecting element and is adapted to pass an electrical current from the second electrode 34 into and through the engine cylinder head 6.

The spark plug second end portion 23 has a chamber 36 defined by a second end portion 38 of the first electrode 28 and has an electrical terminal 40 connected to the spark initiation system. A plurality of serially connected high voltage rectifiers 42,43,44 are connected on one end to the first end portion 46 of the first electrode 28 and on the other end to the spark initiation system 18. The rectifiers 42,43,44 are positioned within the chamber 36 which is filled with one of oil, such as Shell Dialaax, or HV epoxy. Preferably, the chamber 36 is filled with oil. A second end portion 39 of the second electrode 34 extends about the second end portion 38 of the first electrode 28.

Insulation 30 is positioned between the second end portions 38,39 of the first and second electrodes and additionally covers the second end portion 39 of the second electrode 34. The first and second electrode second end portions 38,39 are of a construction sufficient to generate a capacitance greater than about 0.01 μF. The insulated outer surfaces of said first end portion cavity 26 and the second end portion 23 of the of the spark plug 16 have portions, preferably substantially all of which are of non linear configuration. Here, by the term "non linear configuration" it is meant that there are serrations formed about the plug insulation or a series of peaks and valleys formed by circumferential grooves or other constructions which increases the length of a path followed along the longitudinal surface of the insulation. In the preferred embodiment the surface area of the outer surface insulation is greater than about two times the surface area of insulation of cylindrical configuration as measured at the diameters of the insulation valleys.

The ends 20,21 of the first and second electrodes 28,34 at the first end portion 22 of the spark plug 16 are spaced one from the other a distance greater than about 3 mm as measured radially from and about the outer surface of the first electrode 28. It is preferred that the end 50 of the first electrode 28 at the first end portion 46 be of domed configuration and the end 52 of the second electrode 34 at the first end portion 22 of the spark plug 16 be of ring configuration.

Figure 2:
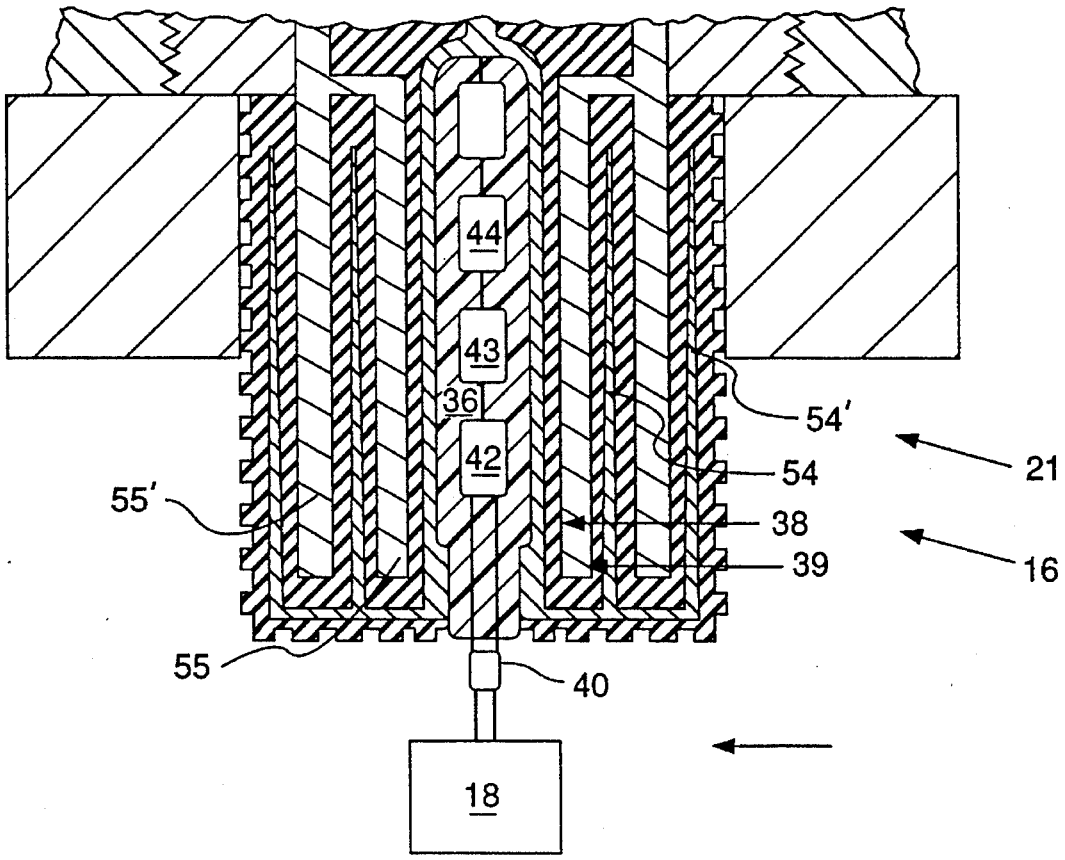
FIG. 2 is a diagrammatic view in cross section showing the second end portion of another embodiment of the invention.

Referring to FIG. 2, the modified embodiment of the spark plug 16 has a second end portion of different configuration designed to have large capacitance within a more compact length. In this embodiment, the second end portion 38 of the first electrode 28 has at least one concentric tube 54 (See FIG. 1) extending about the chamber 36, spaced from the chamber 36 and is connected thereto. As shown in FIG. 2, there are a plurality of tubes 54,54', etc. Insulation 30 covers the concentric tube(s) 54, 54". Where there are a plurality of concentric tubes 54,54', there are concentric second electrode tubes 55,55' positioned between adjacent first electrode tubes 54,54'. As greater capacitance is needed in shorter distances, the number of tubes 54,55 can be increased.

INDUSTRIAL APPLICABILITY

By so constructing the system 4 and spark plug 16 of this invention the spark gap is greatly increased which provides the benefits of a very large, high power, spark capable of igniting leaner mixtures and at higher cylinder pressures. This is accomplished with a low energy system with no penalty in electrode life.

Therefore, in many types of internal combustion engines leaner fuel/air mixtures can be combusted at higher cylinder pressures providing the benefits of lower specific fuel consumption and exhaust emissions.

Other aspects, objects and advantages of this invention can be obtained from a study of the drawings, the disclosure and the appended claims.

We claim:

1. A spark ignition system of an internal combustion engine having a cylinder head, cylinder sidewalls, and a piston defining a combustion zone, said cylinder head having a threaded opening and a spark plug positioned in the opening and in communication with the combustion zone, comprising:

a controllable spark initiation system;

said spark plug having first and second ends and first and second end portions, said spark plug first end portion having a connecting element formed of electrically conductive material having a threaded outer surface mateable with the opening of the cylinder head, a cavity of ring configuration, a first electrode axially positioned within the cavity and insulation extending about the first electrode and walls of the cavity of the first end portion, thereby defining an insulated cavity of ring configuration, and a second electrode of ring configuration positioned between the cavity insulation and the connecting element and in electrical contact with the connecting element;

said spark plug second end portion having a chamber defined by a second end portion of the first electrode, and an electrical terminal connectable to the spark initiation system, and a plurality of serially connected high voltage rectifiers connected on one end to a first end portion of the first electrode and connected on the other end to the spark initiation system and being positioned within the chamber, a second end portion of the second electrode extending about the second end portion of the first electrode and insulation positioned between the second end portions of the first and second electrodes and covering the second end portion of the second electrode, said first and second electrodes second end portions being of a construction sufficient to generate a capacitance greater than about 0.01 μF, and said insulated outer surfaces of said first end portion cavity and said second end portion of the spark plug having portions of non linear configuration.

2. A system, as set forth in claim 1, wherein said insulation outer surface of said first end portion cavity and said second end portion is substantially completely of serrated cross-sectional configuration.

3. A system, as set forth in claim 1, wherein the ends of the first and second electrodes at the first end portion of the spark plug are spaced one from the other a distance greater than about 3 mm as measured radially from and about the outer surface of the first electrode.

4. A system, as set forth in claim 1, wherein the end of the first electrode at the first end portion of the spark plug is of domed configuration and the end of the second electrode at the first end portion of the spark plug is of ring configuration.

5. A system, as set forth in claim 1, wherein the chamber containing the rectifier is filled with one of oil and epoxy.

6. A system, as set forth in claim 1, wherein the chamber containing the rectifiers is filled with HV epoxy.

7. A system, as set forth in claim 1, wherein the second end portion of the first electrode has at least one concentric tube extending about the chamber, spaced therefrom, and being connected thereto and including insulation covering the concentric tube.

8. A system, as set forth in claim 7, wherein there are a plurality of concentric tubes each extending about the chamber, spaced therefrom and having insulation covering the concentric tubes and wherein the second end portion of the second electrode includes a concentric tube extending about the chamber and being positioned between adjacent first electrode tubes and being covered by insulation.

9. A spark plug of an internal combustion engine utilizing ultra lean fuel mixtures and generating high combustion pressures, comprising:

a body having first and second ends and first and second end portions, said first end portion having centrally positioned first electrode and a second electrode of tubular configuration extending about said first electrode and spaced at least about 3 mm therefrom, and thread formed on said first end portion and being mateable with threads of an engine spark plug opening, said second end portion of the spark plug having a plurality of rectifiers serially connected to the first electrode and being encased within the second end portion of the first electrode and said first electrode second end portion being surrounded by the second end portion of the second electrode, said adjacently positioned first and second electrode second end portions are of a construction sufficient for generating a capacitance greater than about 0.01 μF.

10. A spark plug, as set forth in claim 9, including insulation covering the first end portion of the first electrode and the adjacent surface of the first end portion of the second electrode and covering the second end portions of the first and second electrodes.

11. A spark plug, as set forth in claim 10, wherein the insulation between the electrodes first end portion and the insulation on the outer surface of the second end portion of the spark plug is non linear and defined by a multiplicity of peaks and valleys.

12. A spark plug, as set forth in claim 11, wherein the surface area of the insulation between the electrodes first end portion and the insulation on the outer surface of the second end portion of the spark plug is greater than about two times the surface area of insulation of cylindrical configuration as measured at the diameters of the insulation valleys.

* * * * *